United States Patent [19]

Cooper et al.

[11] Patent Number: 4,962,072

[45] Date of Patent: Oct. 9, 1990

[54] PRESSURE SENSITIVE RECORD MATERIAL

[75] Inventors: John B. Cooper, Stokenchurch; Kevin J. Clay, Perivale, both of England

[73] Assignee: The Wiggins Teape Group Limited, Basingstoke, Great Britain

[21] Appl. No.: 299,961

[22] PCT Filed: Dec. 17, 1987

[86] PCT No.: PCT/GB87/00910

§ 371 Date: Jan. 13, 1989

§ 102(e) Date: Jan. 13, 1989

[87] PCT Pub. No.: WO88/04614

PCT Pub. Date: Jun. 30, 1988

[30] Foreign Application Priority Data

Dec. 18, 1986 [GB] United Kingdom ..... 8630231

[51] Int. Cl.[5] ..... B41M 5/22

[52] U.S. Cl. ..... 503/200; 156/295; 156/305; 427/152; 503/207; 503/226

[58] Field of Search ..... 427/150–152; 428/194, 211, 537.5, 914; 503/200, 226, 207; 156/295, 305

[56] References Cited

U.S. PATENT DOCUMENTS

| | | | |
|---|---|---|---|
| 3,931,422 | 1/1976 | Bateman et al. | 427/424 |
| 4,041,193 | 8/1977 | Hayashi et al. | 427/151 |
| 4,335,184 | 6/1982 | Miyamoto et al. | 428/342 |
| 4,397,483 | 8/1983 | Hiraishi et al. | 427/150 |
| 4,567,496 | 1/1986 | Ogata et al. | 503/200 |

FOREIGN PATENT DOCUMENTS

| | | | |
|---|---|---|---|
| 0008161 | 9/1979 | European Pat. Off. | 428/194 |
| 802357 | 4/1955 | United Kingdom | 428/537.5 |
| 1033578 | 6/1963 | United Kingdom | 503/226 |
| 1040549 | 12/1963 | United Kingdom | 503/226 |
| 1263510 | 7/1969 | United Kingdom | 503/226 |
| 1479060 | 10/1974 | United Kingdom | 503/226 |
| 2022646 | 5/1979 | United Kingdom | 503/226 |

*Primary Examiner*—Bruce H. Hess

*Attorney, Agent, or Firm*—Burns, Doane, Swecker & Mathis

[57] ABSTRACT

Record material comprising a paper sheet having on its front a printable pigment coating and on its back isolated droplets of colour former solution each confined within a pressure rupturable barrier, wherein the pigment coating comprises a binder for the pigment together with a synthetic reactive sizing agent or a coating structure agent or both the sizing agent and the coating structure agent.

32 Claims, No Drawings

PRESSURE SENSITIVE RECORD MATERIAL

The invention relates to paper for carbonless copy paper sets and to copy paper sets made up using it.

BACKGROUND

Carbonless copy paper sets consist of a top sheet known as the CB (coated back) sheet, a back sheet known as the CF (coated front) sheet, and optionally one or more intermediate sheets known as CFB (coated front and back) sheets. The coatings of the back of the CB sheet, of the front and back of the CFB sheets if any, and of the front of the CF sheet contain materials that when brought into association with each other develop a coloured image.

When the front of the CB sheet is typed on or otherwise pressure imaged, material is transferred between the back of one sheet and the front of the next through the set to give rise to the copies required. Usually, a solution of a dye precursor or "colour former" carried on the sheet as isolated droplets each confined within a pressure rupturable barrier is transferred from the back of one sheet to the front of the next after rupture of the barrier by the applied pressure, and interacts with a "colour developer" present there to give the image.

All of this is very well known and requires no detailed description.

PIGMENT IN CB-SHEET FRONT COATINGS

The present invention has arisen from a requirement, in the highest grade products, for a pigment-containing coating on the front face of CB sheets, improving them in appearance and in printability.

THE INVENTION

The invention provides record material comprising a paper sheet having on its front a printable pigment coating and on its back isolated droplets of colour former solution each_confined within a pressure rupturable barrier, wherein the pigment coating comprises a binder for the pigment together with a synthetic reactive sizing agent or a coating structure agent or both. The sizing agent is for example an alkyl ketene dimer, alkenyl succinic anhydride, or other neutral reactive size. Another example is a polyurethane size. The coating structure agent is for example a carboxy methyl cellulose, a soya or other protein, an alginate, or other hydrophilic polymer. The relative amounts of components in the coating are desirably by weight 60–95 parts pigment, 10–30 parts binder, 0.5–10 parts size where present and 0.5–5 parts coating structure agent where present. Binder may however be lower, for example down to 5 parts. In options within these ranges, pigment, binder and size are respectively 60–95 parts, 16–22 parts and 0.5–10 parts or pigment, binder and coating structure agent are respectively 75–85 parts, 12–22 parts and 0.5 to 5 parts, with in the latter case optionally 1–5 parts size being present also. Where the coating structure agent is present without size, specific ranges are 75–82 parts pigment, and 15–22 parts binder.

The coating mixes themselves, besides their use, are new and an aspect of the invention as, specifically, are:

A. Multiple form sets each comprising a CB sheet, a CF sheet and optionally one or more CFB sheets, and carrying an edge padding adhesive to join the sheets within the sets and the sets to each other, wherein the CB sheet is of the record material as above, the sizing agent being present to enable the sets to be fanned apart without separation of the sheets within the sets.

B. A method of making a record material comprising a paper sheet having on its front a printable pigment coating and on its back isolated droplets of colour former solution each confined within a pressure rupturable barrier, wherein the paper sheet is coated with a mix containing a binder for the pigment together with a synthetic reactive sizing agent or a coating structure agent, or both the sizing agent and the coating structure agent, in an aqueous medium at 25–75% advantageously 50–65% solids by weight of the mix; is dried to give a coated sheet of Bendtsen porosity 25 to 30 ml/min or more; and is coated on the back at 400 to 450 m/min or more with a colour former coating formulation to give said record material.

C. A method of making multiple form sets each comprising a CB sheet, a CF sheet and optionally one or more CFB sheets and carrying an edge padding adhesive to join the sheets within the sets and the sets to each other, said sets being as a block or fanned apart, wherein a record material as above or produced by the method above is assembled as the CB sheet in association with said CF sheet, and if present said CFB sheet(s) between the CB and CF sheets, repeatedly in a stack, and the edge padding adhesive is applied down one side of the stack and dried, the sizing agent being present in said record material to enable the sets to be fanned apart without separation of the sheets within the sets.

The binder is present to hold the pigment in a non-dusting, printable coating, and to enable enough binder to be used for that purpose it must be a material that when tested at 40 weight % in water gives a fluid preparation mixable with pigment to give a coatable dispersion. Normally it will be a latex binder but for example hydroxyalkyl ether derivatives of starches are suitable. Auxiliary binder materials may also be included.

The size, as discussed further below, is used to hold off latex-based or other edge-padding adhesives to allow form sets to be fanned.

The coating structure agent, as also discussed further below, is a hydrophilic polymer that provides a Bendtsen porosity of the finished i.e. CB coated sheet of not less than 25 ml/min, preferably more. Such porosities reflect porosities before CB coating of around 30 ml/min or more allowing economic application of the CB coating. Suitable materials are believed to act by gelling the pigment coating in the course of drying, preventing it from compacting into an impermeable layer, and all are materials that when tested in water at 25 weight % or more give a gel-like preparation not mixable with pigment to give a coatable dispersion.

It will be understood that as the intention is to improve appearance as well as printability, the pigment coating should not have any significant colour developing properties. Such properties would give rise to edge staining after slitting or sheeting, and possibly other marking arising from capsule rupture and release of colour former solution.

EDGE PADDING

A well known use of copy paper sets is in the production of multiple sets or "form sets". In these, repeats of the sequence of sheets, CB, optionally one or more CFB and CF, that constitute an individual set are made up as a stack. An adhesive, known as an edge padding adhesive, is applied down one side of the stack, its characteristic being that it is attracted to the coating of the back of the CB (and any CFB) sheets, or to the coating of the front of the CF (and any CFB) sheets, or to both, to a greater extent than to what are, conventionally, uncoated faces of the sheets in the stack, which are the fronts of the CB sheets and the backs of the CF sheets. Thus there is only a weak bond between CB sheets and adjacent CF sheets above them and individual sets can be separated from each other by "fanning" without the sheets within the sets coming apart from each other.

However a CB front face pigment coating would be thought of as incompatible with edge padding, the coating attracting the edge padding adhesive in the same way as the coatings within the sets. The invention, in the aspect in which a size is present, overcomes such problems. While of course the use of sizes in paper generally is known, and so is pigment coating and the use of binders to retain the pigment on the paper, there has been no reason to size a pigment coating as such. Indeed a pigment would normally be thought of as incompatible with size, using a lot of it to no purpose, and the success of the combination is surprising.

USE OF HIGH PIGMENT COAT WEIGHTS

Separate from questions of edge padding is a desirability of high pigment coat weights for the best properties of printability and appearance.

The requirement however conflicts with ready application of CB coatings. These, containing colour former in relatively fragile (usually encapsulated) form, must in practice be applied after the coating of the front of the sheet. Application involves use of driving rolls run at high speed with the paper tensioned over them and if air is not to be entrained between paper and roll the paper must have enough permeability for the air to escape. Without it the paper is liable to "hover" on a layer of air over the roll with loss of control of the process and variation in the product. Running the coater at a lower speed to avoid the problem is unacceptable for production efficiency. Increasing the tension to exclude the air is possible in theory but risks damage to the product, e.g. by more frequent breaks and/or curling or inferior aspect.

In conventional pigment coated printing paper, the pigment coating is typically highly consolidated to give a smooth surface. The use of these highly consolidated coatings means that the sheet porosity of the paper is very low. We have however surprisingly found both good binding and permeability, even though the invention uses a high content of binder such as would in itself be expected to give an entirely impermeable coating. The adverse effects of this high content of binder are overcome by the presence in the coating mix of the coating structure agent, sufficient permeability for successful subsequent application of CB coatings being obtained.

The inclusion of the coating structure agent in the coating mix promotes the generation of a relatively porous coating. We believe that this arises because as the coating mix dries, the coating structure agent helps the mix to set or gel before all the water is removed, and that the set or gelled structure is, at least in part, preserved through drying to give a relatively bulky and thus porous coating. That this effect generates a porous coating even at the high binder levels typically used in this invention is very surprising as such binder levels would ordinarily be expected to "blind" the coating.

The reason for the success of the invention appears, though such theory is not to be taken as a limitation of the invention itself, to lie in a microporosity arising from early setting or gelling of the coating as referred to above, without excessive loss of binder into the paper, followed by drying out of the water content of the coating without loss of the structure. It does not appear to arise by a multiple micro-cracking of the coating such as is seen in the colour-developer clay coatings used in CF sheets or the CF face of CFB sheets.

PIGMENTS

The pigments are, generally, conventional paper coating pigments, in particular inorganic or mineral-derived particulate materials. Calcium carbonate especially is economic and suitable, giving good whiteness and purity and having good printing characteristics. It may be supplemented with coating clays such as china clay (kaolin), although with large amounts of clay care will be necessary in formulation to achieve satisfactory rheology and stability for successful coating, as will be appreciated by those skilled in the art.

Other suitable pigments besides china clay include calcined clays, titanium dioxide, finely divided silica and talc.

A mixture of calcium carbonate and china clay, particularly calcined china clay, is preferred. Calcium carbonate contributes good whiteness and brightness, and high print definition, but on its own tends to give dusting on the surface and may not give good ink receptivity. Clay or talc contribute to a good surface finish and give good ink receptivity without dusting but give a less white appearance. Ground calcite as the calcium carbonate has high purity (to give whiteness etc. as compared with ground limestone or chalk) without the very high surface of precipitated carbonates, which can be used but are not preferred because of high binder demand arising from small particle size.

It will be understood that the pigment in the coatings is not such as to have colour developing properties. To this end the inclusion as pigments of specific colour developer materials, such as the clays that are used as the active constituents of many CF coatings, will be avoided. Kaolin has been mentioned in the literature as a colour developer but in unmodified form is not so used or suitable, and paper coating grades are essentially non-colour developing. The use of high levels of binder reduces even further or eliminates any minor residual colour developing activity of the raw material.

The particle size of the pigment is important. The finer the particles are the more effective the pigment is in terms of brightness but, equally, the more the coating is consolidated (thus reducing porosity) and also the more difficult any required sizing is. Particularly in a sizing context, a balance is desirable and the range of 1 to 10 microns, advantageously 2 to 5 microns, is preferred.

Such particle sizes are as measured by a laser particle sizer such as the standard Malvern 3600 E Type. For particles of broadly the same dimensions in any direction, such as those of calcium carbonate, such sizes approximate actual sizes; for flat or elongated particles such as those of coating clays the particle sizes as measured are nominal. The laser instrument assesses particle size by measuring the interference pattern arising from diffraction of the laser light illuminating a sample suspension e.g. in water, of the particles. The pattern is manipulated by a computer to give results as particle size by volume, e.g. the volume itself or the diameter of spheres of equal volume.

Amounts of pigment are given earlier, but a particularly convenient range when size is not being used is 76–80 wt. % of which preferably:

| | |
|---|---|
| 75–88% | $CaCO_3$ |
| 12–25% | China clay, native or calcined, or talc |

75–88%—$CaCO_3$

12–25%—China clay, native or calcined, or talc

Small quantities say up to 10% of specialist pigments, for example $TiO_2$ whitener, can conveniently be included.

BINDERS

Within the constraints above, the binder may be selected from among those conventional in themselves in paper coating technology. In particular it may be a synthetic rubber latex such as styrene butadiene latex (normally a carboxylated grade to give good dispersibility and stability in water) or styrene acrylic latex. It is also however possible for it to be example an ether derivative of starch, as already mentioned, and these are not conventional in the sense of being in wide use.

SIZING AGENTS

The size will typically be a neutral reactive size such as an alkyl ketene dimer or alkenyl succinic anhydride with the alkyl or alkenyl groups from $C_8$ upwards, generally from $C_{12}$ upwards, with $C_{15}$–$C_{18}$ typical and the upper limit determined, for example $C_{24}$, by mix workability and suitability of the final coating for printing. Such sizes, in which "neutral" connotes effectiveness as sizes at neutral coating mix pH, are effective in small quantities and readily provide acceptable rheology in the coating process, for example blade, roll or slot (extrusion) coating as known per se. Other synthetic sizes such as polyurethane sizes may however be used. Amounts within the ranges given earlier are typically 1 to 5% dry weight of the coating but more usually 1 to 2% will be used.

Suitability of sizes will be in terms of water repellency of the coating in an edge padding context. The water repellency of the coating is defined in terms of the contact angle taken up by a water droplet on the surface of the coated paper, measured within the drop, which for a size to be suitable is above 70° and advantageously above 90° or 100°.

A convenient method of determining the contact angle depends on measurement of the observed height and contact width of a droplet of known volume applied to the paper, in particular in a Lorentzen & Wettre No. 28 surface wettability tester. The method is as follows:

(i) A drop of water (initial diameter 4 mm volume ca. 3.35 microliters) is placed on a test strip of paper (ii) The drop height (h) and width of contact of the drop on the paper (w) are measured on a projected image of the drop using a graticule (iii) The contact angle is calculated as $$\theta = 2 \tan^{-1} (2h/w)$$

Since the paper will absorb the water slowly the contact angle is taken as that measured 2 seconds after the drop is placed on the paper.

COATING STRUCTURE AGENTS

The coating structure agents that are suitable include in particular carboxy methyl cellulose such as is used in coating technology as a dewatering control. Other suitable materials are proteins, such as soya protein, and alginates such as sodium alginate, their essential characteristic being to provide the desired porous coating structure at the low amounts specified. The amounts used, within the overall range, depend on the nature of the material, enough to be effective but not so much as to increase viscosity or modify the rheology to make the mix uncoatable.

Amounts are typically, weight % on coating:

| | |
|---|---|
| Carboxy methyl cellulose | |
| high mol. wt. | 0.5–1.5% |
| medium mol. wt. | 1–2% |
| low mol. wt. | 2–3% |
| Sodium alginate | 0.7–1.5% |
| Soya protein | 1.5–4% |

OTHER COMPONENTS

Other agents, known in themselves may also be present in the mix, for example sodium hydroxide or other alkalis such as potassium hydroxide or ammonia for pH adjustment, and further components of the final coating such as optical brightening agents, dispersants for the pigments, lubricants (e.g. calcium stearate) or antifoams.

COAT WEIGHTS

Coat weights may conveniently be 2 to 20 g/m$^2$, advantageously 3 to 15 g/m$^2$. Papers of reduced substance compared to normal, in terms of fibre weight per square meter, may be used compensating in part for the extra cost of the coatings.

POROSITY

For high speed, high quality (good curl: good aspect) CB coating the Bendtsen porosity of the final product is not less than 25 ml/min and preferably not less than 30 ml/min with (for this product) a typical range of 35–50 ml/min. "High speed" is ca. 500 m/min or above and a preferred lower limit 400/450 m/min. A typical range is ca. 600–900 m/min and higher speeds e.g. up to 1500 m/min are possible.

SOLIDS OF TOPCOAT MIX

Widest convenient range 25–75% solids, more usual 30–70%, advantageously 50–65%. Lower solids give a wetter mix and greater drying requirement which restricts machine speed; higher solids may give mix viscosity/rheology problems.

DETAILED PREFERENCES

The invention is described broadly above, but in the edge padding context most desirably provides a CB sheet with a printable front coat at 2–20 g/m$^2$ comprising an inorganic or mineral derived pigment and a latex-derived binder together with a sizing agent, the sizing agent being an alkyl ketene dimer or alkenyl succinic anhydride or other reactive neutral size giving a contact angle of 90° or more. Preferred proportions of components by weight are pigment 60–95 parts, binder 5–30 advantageously 16–22 and size 0.5–10 parts.

In the context wherein edge padding is not an essential, the invention most desirably provides a CB sheet for carbonless copy paper sets carrying in addition to a CB coating a front coating at 3–15 g/m$^2$ comprising pigment 75–82 parts, latex-derived binder 15–22 parts, and coating structure agent 0.5–5 parts, all by weight, such that the finished sheet has a Bendtsen porosity of 25 ml/min or more.

EXAMPLES

The invention is illustrated in the following examples, of which Examples 1 and 2 show the use of a coating structure agent in the absence of size.

EXAMPLE 1

A coating material was prepared from the following components 48.2% solids in water, final pH 9.5.

| Material | Parts by wt. |
|---|---|
| Coating structure agent | 0.8 |
| Sodium hydroxide (first batch) | 0.2 |
| Calcium carbonate pigment | 60.1 |
| China clay pigment | 20.0 |
| Latex binder | 16.0 |
| Optical brightener | 0.8 |
| Sodium hydroxide (remainder) | 0.1 |
| Mix Procedure | |
| Place water in a high speed mixing vessel | |
| Add the dry coating structure agent and stir for 15 minutes at high speed | |
| Add first batch of NaOH (40% solids) | |
| Add calcium carbonate and china clay and stir for 30 minutes at high speed | |
| Check pH and adjust to approximately 10.0 with some of the remaining NaOH | |
| Reduce the stirring speed to slow, add the binder and stir for 10 minutes | |
| Add the optical brightener | |
| Bring final pH to 9.5 with NaOH. | |

MATERIALS (i) The coating structure agent is a medium molecular weight carboxymethyl cellulose.

(ii) The calcium carbonate pigment is a ground calcite, desirable as high-white material economic in cost. Its median particle size is 2.8 microns.

(iii) The china clay is a fine, white, commercially available coating clay, median particle size 3.3 microns. It acts as a white pigment accordingly, while preserving the advantages of clay coatings generally in terms of coat adhesion and printing characteristics. It gives no unacceptable reduction in the brightness of coating given by the calcium carbonate.

(iv) The binder is a conventional carboxylated styrenebutadiene synthetic latex giving the coating the necessary adhesion as a whole.

The coating mix so prepared was applied using trailing blade metering to standard base paper of 48 g/m$^2$ substance for 'Idem' (Trade Mark) CB sheet to give coat weights of 3 to 7 g/m$^2$. The coated paper was then calendered and its porosity checked and found to be at a suitable figure. It was CB coated at 800 m/min using a 3 roll coater head, solids of the coating mix ca. 24%, constitution of solids:

70% capsules—conventional gelatin-based capsules, black-copy colour former formulation in solvent, formed by coacervation encapsulation 20% stilt—cellulose floc, ungelatinised starch particles or mixture.

10% binder—maize starch and dried to give ca 4.5 g/m$^2$ coat weight (dry). A steam shower was used to remove/reduce curl otherwise present from paper wetting during coating.

The resulting CB sheets had excellent printing characteristics and improved visual appeal and feel in terms of formation and roughness.

EXAMPLE 2

Similarly to Example 1, a coating material was prepared from the following components, made up to 3308 Kg with water

| Component | Dry weight (Kg) | Approx. % of dry weight |
|---|---|---|
| 'Dispex' N 40 (40% in water) dispersing agent | 3.6 | 0.2 |
| 'Hydrocarb' 70 calcium carbonate pigment | 1275 | 64.5 |
| Sodium hydroxide (30% in water) | 2.4 | 0.12 |
| 'Alphatex' calcined kaolin (china clay) pigment | 300 | 15.2 |
| Carboxymethyl cellulose coating structure agent | 24 | 1.2 |
| 'Revinex' 98 F10 latex (50% solids in water) | 360 | 18.2 |
| 'Nopcote' C 104 (50% in water) calcium stearate | 10 | 0.5 |

Revinex 98 F10 latex is a carboxylated SBR latex ex Doverstrand Limited. 'Dispex', 'Hydrocarb', 'Alphatex', 'Revinex' and 'Nopcote' are trade marks.

This coating was applied to a conventional CB base paper containing 'Leucophor' (Trade Mark) LN optical brightener which after checking porosity was given a CB coating as before. A CB paper of excellent printability was given without problems in the CB coating process.

EXAMPLES 3 AND 4

Examples 1 and 2 were repeated with respectively 2 parts by weight and 24 Kg of 'Aquapel' (Trade Mark) 360×3 neutral $C_{16}$ alkyl ketene dimer size (the level used being such as to give a final coating contact angle of 110°. Papers of excellent printability and, further, edge paddable with 100% fanning were obtained.

EXAMPLES 5 AND 6

These are further Examples with coating structure agent and size together, mixes as below, with water to total 3630 parts, i.e. solids of mix=55%

| | Example 5 | | | Example 6 | | |
|---|---|---|---|---|---|---|
| Component | Wet Parts | Dry Parts | % | Wet Parts | Dry Parts | % |
| 'Hydrocarb' 70 calcium carbonate | 1275 | 1275 | 63.8 | 1259 | 1259 | 63.0 |
| 'Alphatex' calcined kaolin | 300 | 300 | 15 | 300 | 300 | 15 |
| 'Dispex' N40 | 9.1 | 3.6 | 0.18 | 9.1 | 3.6 | 0.18 |

-continued

| Component | Example 5 Wet Parts | Example 5 Dry Parts | Example 5 % | Example 6 Wet Parts | Example 6 Dry Parts | Example 6 % |
|---|---|---|---|---|---|---|
| dispersing agent | | | | | | |
| CMC (med mol. wt.) coating structure agent | 24 | 24 | 1.2 | 40 | 40 | 2.0 |
| 'Aquapel' 360 × 3 size | 322.5 | 24 | 1.2 | 322.5 | 24 | 1.2 |
| 'Revinex' 98F10 latex binder | 720 | 360 | 18 | — | — | — |
| Dow 620 latex binder | — | — | — | 720 | 360 | 18 |
| 'Nopcote' C104 calcium stearate | 20 | 10 | 0.5 | 20 | 10 | 0.5 |

Procedures for preparation of the coating mix and its application are as in Examples 1 and 2. Measured porosities (Bendtsen) are:

| | Ex. 5 | Ex. 6 |
|---|---|---|
| Before CB coat | 40.2 | ca.40 |
| After | 35.4 | ca.35 |

and, generally, similarly successful results to Examples 1 and 2 are obtained.

EXAMPLE 7

The following is again of the use of a coating structure agent and size together, and is in effect six examples in one (three mixes each coated at two levels).

The formulations were made and coated as in Example 1, the calcium carbonate being of 4 microns median particle size, at 3 and 6 g/m$^2$, on the rougher side of 'Idem' base paper as used in Example 1.

| | Material | Dry parts | |
|---|---|---|---|
| Mix 1 | Calcium carbonate | 100 | |
| | Binder | 22 | Total |
| | Coating structure agent | 1 | 55% solids |
| | Size | 2.5 | pH 9.5 |
| | Optical brightener | 1 | |
| Mix 2 | Calcium carbonate | 75 | |
| | China clay | 25 | Total |
| | Binder | 20 | 50% solids |
| | Coating structure agent | 1 | pH 9.5 |
| | Size | 2.5 | |
| | Optical brightener | 1 | |
| Mix 3 | Calcium carbonate | 50 | |
| | China clay | 50 | Total |
| | Binder | 20 | 47% solids |
| | Coating structure agent | 1 | pH 9.5 |
| | Size | 3.7 | |
| | Optical brightener | 1 | |

The pairs of samples, all of which showed satisfactory porosities, were subjected to physical testing, in comparison to the uncoated base itself, on a number of criteria significant to CB sheet performance.

(a) Roughness

Lower values (of rate of passage of air) indicate improved smoothness

| | |
|---|---|
| Base | 220 ml/min |
| 3 g/m$^2$ samples | 170 ml/min |
| 6 g/m$^2$ samples | 140 ml/min |

(b) Contact Angle

| | |
|---|---|
| Base | 118° |
| Mix 1, both samples | 117° |
| Mix 2, both samples | 116° |
| Mix 3, both samples | 111° |

These are all very good values of above 110° and, it may be noted, do not vary with the coating weight.

(c) Cobb

Lower Cobb values (of water uptake) represent improvement.

| | |
|---|---|
| Base | 19.0 g/m$^2$/min |
| Other samples | 15.5–17.0 g/m$^2$/min |

(d) Whiteness/Brightness

A. Elrepho

Values calculated using filters 9, 10, 11, the brightness being given by the filter 11 value.

| | Brightness | Lightness | a | b |
|---|---|---|---|---|
| Base | 87.3 | 96.96 | 15.85 | −8.81 |
| Coatings | 88.5 to 89.1 | 96.24 | 16.16 to 16.42 | −9.29 to −9.83 |

+ a = redder
− a = greener
+ b = yellower
− b = bluer.

B. Macbeth IC System.

Results were taken with the U.V. in. Significant improvement was seen in reflectance at 440 nm.

| Sample | Coat weight g/m | 440 nm Reflectance | L D65 | a D65 | b D65 |
|---|---|---|---|---|---|
| Base | — | 88.95 | 95.54 | −0.05 | 0.32 |
| Run 1 | 3 | 91.19 | 95.19 | 0.24 | −0.67 |
| Run 2 | 6 | 92.64 | 95.60 | 0.39 | −0.74 |
| Run 3 | 3 | 91.43 | 95.31 | 0.19 | −0.65 |
| Run 4 | 6 | 92.14 | 95.61 | 0.32 | −0.52 |
| Run 5 | 3 | 91.03 | 95.85 | 0.20 | 0.27 |
| Run 6 | 6 | 91.30 | 95.78 | 0.29 | 0.11 |

(e) I G T Pick

Using Spring A (35 Kgf) and medium oil, Mix 1 and Mix 2 show improvements on the base and Mix 3 approximately equal values to the base, all satisfactory.

In a printing trial, mix 1, 2 and 3 papers, which had been CB coated with production black copy formulation with control samples from normal production CB, were printed on a Muller-Martini webb offset printing machine using 'Irlam T11392' (Trade Mark) black ink and a speed of 670 rpm (250 m/min). The Mix 1, 2 and 3 papers all showed low dust, with good ink density/intensity, very little set off, and IGT pick very low or not visible.

In an edge padding trial, form sets were made up using a latex-based adhesive with CB, 2×CFB, and CF sheets, the CFB and CF sheets being standard 'Idem' production and the CB sheets being either standard 'Idem' production base, for comparison, or the Mix 1, 2 and 3 papers above. All sets fanned apart 100%. Bonding strengths within sets, on a subjective 1 to 5 scale (too weak, slightly weak, optimum, slightly strong, too strong) were acceptable throughout, the CB-CF bond in particular, though a little less strong with the Mix 1, 2 and 3 papers than with the base, giving no problem through the presence of the front coating.

EXAMPLE 8

In a further multi-part example the formulation below was made up as before, first as shown (Example 8-C) then with the following changes, substitutions being weight for weight:

Example 8-2—Mistron Vapour 3 P (Trade Mark) talc as pigment replacing the kaolin clay Example 8-5—Solfarex A 55 (Trade Mark) starch hydroxyalkyl ether as binder replacing latex Example 8-7—Cyclopal A (Trade Mark) anionic modified polyurethane as size replacing the 'Aquapel'

Example 8-10—CMC coating structure agent omitted

Example 8-11—Procote 400 (Trade Mark) soy protein as coating structure agent replacing the CMC

FORMULATION

EXAMPLE 8-C

Components are given in the order, pigment, binder, other components, not the order of addition used in mix preparation.

| Material | Description | % (w/w) |
|---|---|---|
| Hydrocarb 70 | Calcium carbonate pigment | 63.9 |
| Alphatex | Calcined kaolin clay pigment | 15.0 |
| Dow 620 | Styrene butadiene latex binder | 18.0 |
| Aquapel 360X | Alkyl ketene dimer size | 1.2 |
| Finfix 5 | Carboxy methyl cellulose coating structure agent | 1.2 |
| Nopcote C104 | Calcium stearate lubricant | 0.5 |
| Dispex N40 | Sodium polyacrylate dispersing agent | 0.18 |
| Sodium Hydroxide | — | 0.04 |
| Leucophor LN | Optical brightening agent | — |
| Solids = 55% | | |

The formulations were coated onto base paper as in Example 1, the machine speed being 400 m/min, and measurements made of important properties. The following table shows the mix viscosity of the coating mix, together with porosity before and after application of the CB coat, contact angle, and Bendtsen roughness.

Test Results - Example 8

| Example | Coat Mix Viscosity (cPs) | Porosity Before CB (ml/min) | Porosity After CB (ml/min) | Contact Angle (Degrees after 2 seconds) | Roughness (Bendtsen) |
|---|---|---|---|---|---|
| 8-C | 520 | 31.5 | 25.0 | 77.6 | 119.0 |
| 8-2 | 505 | 38.3 | 13.0 | 79.0 | 100.0 |
| 8-5 | 800 | 25.2 | 26.0 | 108.9 | 125.0 |
| 8-7 | 525 | 27.3 | 26.5 | 79.1 | 132.0 |
| 8-10 | 195 | 55.2 | 60.4 | 89.8 | 150.0 |
| 8-11 | 102 | 25.0 | 23.0 | 95.8 | 146.0 |

In addition to the above tests edge padding trials were carried out as before, with bond strengths found normal or slightly low (but still within-specification) CB-CFB and CFB-CF and 100% fan apart. Printing trials, again carried out as before, gave good results, the ink on this occasion being Bonsfield Constat Black 30862 (Trade Mark). Ink density was good (slightly light in the absence of the coating structure agent), piling was absent, dusting acceptable throughout and in the mix with starch ether binder exceptionally low.

EXAMPLE 9

In a further example a coat mix was made up as an Example 8-C but with the Aquapel 360X replaced by 3.6 parts by weight of 'Fibran 71' (Trade Mark) from National Starch & Chemical Co., which is an alkenyl succinic anhydride size, the other components being in relative parts by weight as shown there, and coated as before. A satisfactory coating was given, the measured contact angle in particular being 104°, well suited to edge padding.

We claim:

1. A record material comprising a paper sheet having on its front a printable pigment coating and on its back isolated droplets of color former solution each confined within a pressure rupturable barrier, wherein the pigment coating comprises (a) a pigment, (b) a binder for the pigment and (c) at least one of (i) a sizing agent and (ii) a coating structure agent.

2. A record material according to claim 1 including the sizing agent, wherein said sizing agent is selected from at least one of an alkyl ketene dimer, an alkenyl succinic anhydride or other neutral reactive size.

3. A record material according to claim 1 including the sizing agent, wherein the sizing agent is a polyurethane size.

4. A record material according to claim 1 including the sizing agent, wherein the water repellency of the pigment coating, in terms of the contact angle taken up by a water droplet on the surface of the coated paper, is above 90°.

5. A record material according to claim 4, wherein the water repellency is above 100°.

6. A record material according to claim 1 including the coating structure agent, wherein the coating structure agent is a hydrophilic polymer.

7. A record material according to claim 6, wherein the hydrophilic polymer is selected from at least one of a carboxyl methyl cellulose, a protein or an alginate.

8. A record material according to claim 7, wherein the protein is soya.

9. A record material according to claim 1, wherein the binder is a synthetic rubber latex binder.

10. A record material according to claim 9, wherein the binder is a styrene butadiene binder or a styrene acrylic latex binder.

11. A record material according to claim 1, wherein the binder is a hydroxy alkyl ether starch derivative.

12. A record material according to claim 1, said pigment, from about 10 to about 30 parts by weight binder, from 0 to about 10 parts by weight sizing agent, and from 0 to about 5 parts by weight coating structure agent.

13. A record material according to claim 12, said material comprising, from about 60 to about 95 parts by weight pigment, from about 16 to about 22 parts by weight binder, and from about 0.5 to about 10 parts by weight sizing agent.

14. A record material according to claim 12, said material comprising from about 75 to about 85 parts by weight pigment, from about 12 to about 22 parts by weight binder and from about 0.5 to about 5 parts by weight coating structure agent.

15. A record material according to claim 12, said material comprising from about 75 to about 85 parts by weight pigment, from about 12 to about 22 parts by weight binder, from about 1 to about 5 parts by weight sizing agent, and from about 0.5 to about 5 parts by weight coating structure agent.

16. A record material according to claim 1, wherein the coat weight of the front coating is from about 2 to about 20 g/m$^2$.

17. A record material according to claim 16, wherein the coat weight of the front coating is from about 3 to about 15 g/m$^2$.

18. A record material according to claim 1, wherein the pigment comprises an inorganic particulate material.

19. A record material according to claim 18, wherein the pigment is mineral-derived.

20. A record material according to claim 18, wherein the pigment comprises calcium carbonate.

21. A record material according to claim 1, wherein the particle size of the pigment ranges from about 1 to about 10 microns.

22. A record material according to claim 21, wherein the particle size of the pigment ranges from about 2 to about 5 microns.

23. A record material according to claim 1 including the sizing agent, wherein the sizing agent is selected from an alkyl ketene dimer having a $C_8$–$C_{24}$ alkyl group, or an alkenyl succinic anhydride having a $C_8$–$C_{24}$ alkenyl group.

24. A record material according to claim 23, wherein the sizing agent is selected from an alkyl ketene dimer having a $C_{12}$–$C_{24}$ alkyl group, or an alkenyl succinic anhydride having a $C_{12}$–$C_{24}$ alkenyl group.

25. A multiple form set comprising a CB sheet and a CF sheet, wherein said CB sheet includes a record material comprising a paper sheet having on its front a printable pigment coating and on its back isolated droplets of color former solution each confined within a pressure rupturable barrier, wherein the pigment coating comprises (a) a pigment, (b) a binder for the pigment, (c) a sizing agent operable to prevent separation of the sheets within the set upon fanning of the set, and optionally, (d) a coating structure agent, and wherein the sheets of the set carry an edge padding adhesive to join the sheets within the set.

26. A multiple form set according to claim 25, further comprising at least one CFB sheet between said CB sheet and said CF sheet, wherein the CFB sheet(s) also carry the edge padding adhesive.

27. Multiple form sets comprising at least two multiple form sets according to claim 25, each set carrying an edge padding adhesive to join the sets.

28. Multiple form sets comprising at least two multiple form sets according to claim 26, each set carrying an edge padding adhesive to join the sets.

29. A method of making a record material, wherein the record material comprises a paper sheet having on its front a printable pigment coating and on its back isolated droplets of color former solution each confined within a pressure rupturable barrier, the pigment coating comprising (a) a pigment, (b) a binder for the pigment and (c) at least one of (i) a sizing agent and (ii) a coating structure agent, said method comprising;

(1) coating one side of a paper sheet with an aqueous pigment coating mixture comprising components (a), (b) and (c), wherein the aqueous mixture contains from about 25 to about 75% solids by weight of the mixture;

(2) drying the sheet to provide a coated sheet having a Bendtsen porosity of at least about 25 ml/min; and (3) coating the other side of the sheet with the color former coating formulation at a rate of at least about 400 m/min.

30. A method according to claim 29, wherein the aqueous mixture contains from about 50 to about 65% solids by weight of the mixture.

31. A method of making multiple form sets comprising;

(1) stacking at least two form sets comprising a CB sheet, a CF sheet, and optionally, at least one CFB sheet stacked between said CB sheet and said CF sheet, wherein said CB sheet includes a record material comprising a paper sheet having on its front a printable pigment coating and on its back isolated droplets of color former solution each confined within a pressure rupturable barrier, wherein the pigment coating comprises (a) a pigment, (b) a binder for the pigment, (c) a sizing agent to prevent separation of the sheets within the sets upon fanning of the sets, and optionally, (d) a coating structure agent;

(2) providing an edge padding adhesive on one side of the stack; and (3) drying the stack.

32. A method according to claim 31, further comprising fanning the multiple form sets.

* * * * *